US007605643B2

(12) United States Patent
Kuriyama

(10) Patent No.: US 7,605,643 B2
(45) Date of Patent: Oct. 20, 2009

(54) VOLTAGE GENERATION CIRCUIT AND METHOD THEREOF

(75) Inventor: Masao Kuriyama, Yokohama (JP)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 12 days.

(21) Appl. No.: 11/812,682

(22) Filed: Jun. 21, 2007

(65) Prior Publication Data

US 2007/0296487 A1 Dec. 27, 2007

(30) Foreign Application Priority Data

Jun. 21, 2006 (JP) ..... 2006-171646

(51) Int. Cl.
*G05F 1/10* (2006.01)

(52) U.S. Cl. ..... 327/540; 327/538

(58) Field of Classification Search ..... 327/538–543
See application file for complete search history.

(56) References Cited

U.S. PATENT DOCUMENTS 4,853,646 A * 8/1989 Johnson et al. ..... 330/256
5,781,140 A * 7/1998 Kao ..... 341/154
6,028,640 A * 2/2000 Nayebi et al. ..... 348/525
6,903,601 B1 * 6/2005 Aude ..... 327/541
7,196,567 B2 * 3/2007 Nguyen ..... 327/308
7,208,998 B2 * 4/2007 Abel ..... 327/538
7,212,046 B2 * 5/2007 Hur ..... 327/143
7,253,677 B1 * 8/2007 Kuramochi ..... 327/538
2002/0036490 A1 * 3/2002 Tagami et al. ..... 323/316
2006/0056485 A1 * 3/2006 Hartley ..... 374/170
2006/0091934 A1 * 5/2006 Pan ..... 327/534
2006/0238235 A1 * 10/2006 Wey et al. ..... 327/543
2007/0052405 A1 * 3/2007 Mochizuki et al. ..... 323/316

* cited by examiner

*Primary Examiner*—Lincoln Donovan
*Assistant Examiner*—Thomas J Hiltunen
(74) *Attorney, Agent, or Firm*—Harness, Dickey & Pierce, P.L.C.

(57) ABSTRACT

A voltage generation circuit may include a static current circuit and/or a current mirror. The static current circuit may include a first resistor. The current mirror may include a second resistor, a third resistor, and/or an output terminal.

13 Claims, 5 Drawing Sheets

VOLTAGE GENERATION CIRCUIT AND METHOD THEREOF

PRIORITY STATEMENT

This U.S. non-provisional patent application claims the benefit of priority under 35 U.S.C. § 119 to Japanese Patent Application No. JP-2006-171646 filed on Jun. 21, 2006, the entire contents of which are incorporated herein in their entirety by reference.

BACKGROUND

1. Field

Example embodiments relate to a voltage generation circuit and/or a method thereof, and for example, to a voltage generation circuit generating a voltage smaller than a power source voltage in potential and/or a method of generating a voltage smaller than a power source voltage in potential.

2. Description of Related Art

FIG. 4 shows a conventional static-voltage generation circuit configured to generate a static voltage in a semiconductor memory device. Referring to FIG. 4, first and second reference potentials VREF1 and VREF2 link with inverted input nodes of first and second operational amplifiers 30 and 31, respectively. Non-inverted input nodes of the operational amplifiers 30 and 31 are coupled to a central tap P of a resistor 34 in common. A source of a PMOS transistor 32 is connected to a power source voltage VCC and a gate of the PMOS transistor 32 is coupled to an output node of the first operational amplifier 30. A drain of an NMOS transistor 33 is connected to a drain of the PMOS transistor 32 and a gate of the NMOS transistor 33 is coupled to an output node of the second operational amplifier 31. A source of the NMOS transistor 33 is connected to a ground. The resistor 34 is connected between the drain of the NMOS transistor 33 and the ground. An output terminal 35 is connected to the drain of the NMOS transistor 33.

The first and second operational amplifiers 30 and 31 compare a voltage, which is divided from a voltage of the output terminal 35 by the central tap P of the resistor 34, with the first and second reference voltage potentials VREF1 and VREF2, respectively. According to a result of the comparison, the PMOS and NMOS transistors 32 and 33 are controlled to generate a required voltage at the output terminal 35. In generating the required voltage at the output terminal 35 lower than the power source voltage, a smaller gap between the power source voltage and an output voltage, e.g., the required voltage at the output terminal 35, causes a larger difference between operation ranges, for example a rising up and falling down, of the output voltage. Because of the larger difference between operation ranges of the output voltage, a valance of amplification rates may vary more widely, more easily causing instability in a level of the output voltage. As a result, it is more difficult to stabilize an output voltage level in a shorter time.

However, another conventional reference voltage generation circuit is configured to generate a reference voltage lower than a power source voltage. In another conventional reference voltage generation circuit, an N-channel depletion transistor M3 having a gate and source which are saturation-connected with each other for generating first constant currents is employed. However, in a semiconductor memory device, current characteristics of MOS transistors are more easily affected from disproportion of fabrication processes and temperature variation.

SUMMARY

Example embodiments may provide a voltage generation circuit configured to generate a smaller voltage with stability, and/or establish a supply current and/or transition a voltage of a load at a higher frequency with the smaller voltage.

Example embodiments may provide a voltage generation method generating a smaller voltage with stability, and/or establishing a supply current and/or transitioning a voltage of a load at a higher frequency with the smaller voltage.

According to an example embodiment, a voltage generation circuit may include a static current circuit and/or a current mirror. The static current circuit may be configured to receive a reference potential, maintain a first current flowing through a first resistor, and/or output a first voltage. The current mirror configured may be configured to receive the first voltage, maintain a second current flowing through a second resistor in response to the first voltage, the second current being equal to the first current, maintain a third current flowing through a third resistor in response to the first voltage, the third current being equal to a number n times the second current, and/or output an output voltage equal to a voltage level of the voltage across terminals of the third resistor.

According to an example embodiment, a voltage generation circuit may include a static current circuit and/or a current mirror. The static current circuit may include an operation amplifier, a first PMOS transistor, and/or a first resistor. The operational amplifier may include an inverted input terminal configured to receive a reference potential. The first PMOS transistor may include a drain and gate connected to an non-inverted input terminal and an output node of the operational amplifier, respectively, and/or a source connected to a power source voltage. The first resistor may be connected between the drain of the first PMOS transistor and a ground. The current mirror may include a second PMOS transistor, a first NMOS transistor, a second resistor, a third PMOS transistor, a second NMOS transistor, a third resistor, and/or an output terminal. The second PMOS transistor may include a source connected to the power source voltage and/or a gate connected to the gate of the first PMOS transistor. The first NMOS transistor may include a drain and gate commonly connected to a drain of the second PMOS transistor. The second resistor may be connected between a source of the first NMOS transistor and the ground. The third PMOS transistor may include a source connected to the power source voltage and a gate and drain connected to each other. The second NMOS transistor may include a drain connected to the drain of the third PMOS transistor and a gate connected to the gate of the first NMOS transistor. The third resistor may be connected between a source of the second NMOS transistor and the ground. The output terminal may be connected to the source of the second NMOS transistor.

According to an example embodiment, a voltage generation circuit may include a static current circuit, a level shifter, and/or a current mirror. The static current circuit may include an operation amplifier, a first PMOS transistor, and/or a first resistor. The operational amplifier may include an inverted input terminal configured to receive a reference potential. The first PMOS transistor may include a drain and gate connected to an non-inverted input terminal and an output node of the operational amplifier, respectively, and a source connected to a power source voltage. The first resistor may be connected between the drain of the first PMOS transistor and a ground. The level shifter may include a fourth PMOS transistor and/or a third NMOS transistor. The fourth PMOS transistor may include a source connected to the power source voltage and/or a gate connected to the gate of the first PMOS transistor. The third NMOS transistor may include a drain and gate commonly connected to a drain of the fourth PMOS transistor. The current mirror may include a first NMOS transistor, a second PMOS transistor, a second resistor, a second NMOS transistor, a third PMOS transistor, a third resistor, and/or an output terminal. The first NMOS transistor may include a source connected to the ground and a gate connected to the gate of the third NMOS transistor. The second PMOS transistor may include a drain and gate commonly connected to a drain of the first NMOS transistor. The second resistor may be connected between a source of the second PMOS transistor and the power source voltage. The second NMOS transistor may include a source connected to the ground and/or a drain and gate connected to each other. The third PMOS transistor may include a drain connected to the drain of the second NMOS transistor and/or a gate connected to the gate of the second PMOS transistor. The third resistor may be connected between a source of the third PMOS transistor and the power source voltage. The output terminal may be connected to the source of the third PMOS transistor.

According to an example embodiment, the first through third resistors may include at least one of a polysilicon layer, a diffusion layer, and a composite of a polysilicon layer and a diffusion layer.

According to an example embodiment, the reference potential may be generated by a band gap reference circuit.

According to an example embodiment, an output of the current mirror may be provided to a row decoder of a semiconductor memory device.

According to an example embodiment, a resistance of the third resistor may be 1/n the resistance of the second resistor.

According to an example embodiment, the first and second PMOS transistors may have the same gate width to length (W/L) ratio, and/or the gate width to length (W/L) ratios of the third PMOS transistor and the second NMOS transistor may be n times the gate width to length (W/L) ratio of the second PMOS transistor.

According to an example embodiment, the first and fourth PMOS transistors may have the same gate width to length (W/L) ratio, the first NMOS transistor and the third NMOS transistor have the same gate width to length (W/L) ratio, and/or the gate width to length (W/L) ratios of the third PMOS transistor and the second NMOS transistor may be n times the gate width to length (W/L) ratios of the second PMOS transistor and the first NMOS transistor.

According to an example embodiment, a method of generating an output voltage may include receiving a reference potential. A first current flowing through a first resistor may be maintained and/or a first voltage may be generated in response to the reference potential. A second current flowing through a second resistor may be maintained in response to the first voltage. The second current may be equal to the first current. A third current flowing through a third resistor may be maintained in response to the first voltage. The third current may be equal to a number n times the second current. An output voltage equal to a voltage level of the voltage across terminals of the third resistor may be output.

BRIEF DESCRIPTION OF THE DRAWINGS

The above and/or other aspects and advantages will become more apparent and more readily appreciated from the following detailed description of example embodiments taken in conjunction with the accompanying drawings of which.

DETAILED DESCRIPTION OF EXAMPLE EMBODIMENTS

Figure 1:
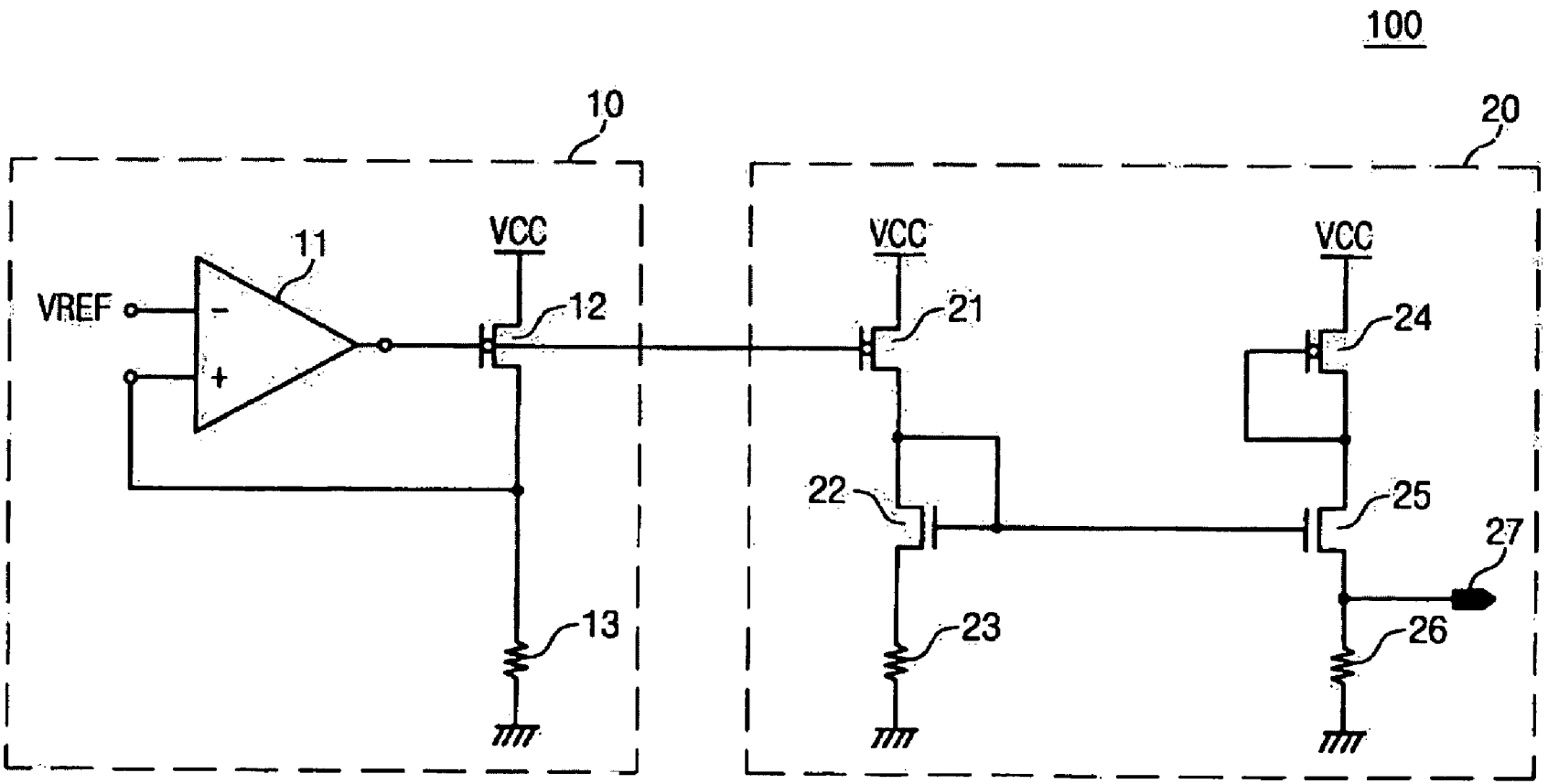
FIG. 1 is an example circuit diagram illustrating a voltage generation circuit according to an example embodiment.

Example embodiments will now be described more fully hereinafter with reference to the accompanying drawings. Embodiments may, however, be in many different forms and should not be construed as being limited to the example embodiments set forth herein. Rather, these example embodiments are provided so that this disclosure will be thorough and complete, and will fully convey the scope to those skilled in the art. In the drawings, the thicknesses of layers and regions may be exaggerated for clarity.

It will be understood that when a component is referred to as being "on," "connected to" or "coupled to" another component, it can be directly on, connected to or coupled to the other component or intervening components may be present. In contrast, when a component is referred to as being "directly on," "directly connected to" or "directly coupled to" another component, there are no intervening components present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the example embodiments.

Spatially relative terms, such as "beneath," "below," "lower," "above," "upper" and the like, may be used herein for ease of description to describe one component or feature's relationship to another component(s) or feature(s) as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, and/or components.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Reference will now be made to example embodiments, which are illustrated in the accompanying drawings, wherein like reference numerals refer to the like components throughout.

FIG. 1 is an example circuit diagram illustrating a voltage generation circuit according to an example embodiment. Referring to FIG. 1, the voltage generation circuit 100 may include a static current circuit 10 and/or a current mirror 20.

The static current circuit 10 may include an operational amplifier 11, a first PMOS transistor 12, and/or a first resistor 13. A reference potential VREF may be provided to an inverted input node (−) of the operational amplifier 11. A drain and gate of the first PMOS transistor 12 may be connected to the non-inverted input node (+) and an output node of the operational amplifier 11, respectively. A source of the first PMOS transistor 12 may be connected to a power source voltage VCC. The first resistor 13 may be connected between the drain of the first PMOS transistor 12 and a ground.

The current mirror 20 may include second and third PMOS transistors 21 and 24, first and second NMOS transistors 22 and 25, and/or second and third resistors 23 and 26.

A source of the second PMOS transistor 21 may be connected to the power source voltage VCC, and/or a gate of the second PMOS transistor 21 may be coupled to the gate of the first PMOS transistor 12. A drain and gate of the first NMOS transistor 22 may be connected to each other and/or connected to a drain of the second PMOS transistor 21. The second resistor 23 may be connected between a source of the first NMOS transistor 22 and the ground.

A source of the third PMOS transistor 24 may be connected to the power source voltage VCC, and/or a gate and drain of the third PMOS transistor 24 may be connected to each other. A drain of the second NMOS transistor 25 may be connected to the drain of the third PMOS transistor 24 and a gate of the second NMOS transistor 25 may be connected to the gate of the first PMOS transistor 22. The third resistor 26 may be connected between a source of the second NMOS transistor 25 and the ground. An output terminal 27 of the voltage generation circuit 100 may be connected to the source of the second NMOS transistor 25.

If the reference potential VREF is applied to the inverted input node (−) of the operational amplifier 11, the operational amplifier 11 may operate to maintain a source potential of the first PMOS transistor 12 at the reference potential VREF. If the resistance of the first resistor 13 is R1, a current I1 flowing through the first resistor 13 is I1=VREF/R1. Because the first PMOS transistor 12 and the first resistor 13 form a source follower, the first PMOS transistor 12 may operate to maintain the current I1.

For example, if the first and second PMOS transistors 12 and 21 have the same gate width to length (W/L) ratio, a current I2 flowing through the second resistor 23 may be the same as the current I1 flowing through the first resistor 13 because an output voltage of the operational amplifier 11 is applied to the gates of the first and second PMOS transistors 12 and 21. For example, I1=I2. Accordingly, if the resistance of the second resistor 23 is R2 and a terminal voltage across the second resistor 23 to the ground is V2, V2=I2*R2=(R2/R1)*VREF.

If the gate width to length (W/L) ratios of the third PMOS transistor 24 and the second NMOS transistor 25 are a number n times the gate width to length (W/L) ratios of the second PMOS transistor 21 and the first NMOS transistor 22, a current I3 flowing through the third resistor 26 of the current mirror 20 may be I3=n*I2. If the resistance R3 of the third resistor 26 is set to 1/n of the resistance R2 of the second resistor 23, a terminal voltage V3 across the third resistor 26 to the ground is V3=I3*R3=n*I2*R2/n=I2*R2=V2.

Therefore, in a case of requiring a smaller static voltage less than 1.0V, the voltage generation circuit 100 may be able to receive a substantially constant voltage of about 1.25V, regardless of temperature and/or voltage variation, by generating the reference potential VREF from a bandgap reference circuit. For example, a smaller static voltage less than 1.0V may be obtained from optimizing the resistance R2 of the resistor 23.

In a case of transitioning a load into the smaller voltage from the ground, the voltage generation circuit 100 may be able to charge the load at a higher frequency because the second NMOS transistor 25 driving the load may operate in the form of a source follower. The gate width to length (W/L) ratios of the third PMOS transistor 24 and the second NMOS transistor 25 may be the number n times the gate width to length (W/L) ratio of the second PMOS transistor 21 and/or the current I1 may be maintained by the first PMOS transistor 12 to increase an active drivability. The resistance R3 of the third resistor 26 may be 1/n of the resistance R2 of the second resistor 23. Accordingly, it may be possible to set n times drivability to a larger capacity of load.

The first resistor 13, the second resistor 23, and the third resistor 26 may include a polysilicon layer, a diffusion layer, or a composite of a polysilicon layer and a diffusion layer. Accordingly, a process imbalance may be lightened, for example, as compared to a process imbalance of a transistor-type device, and/or a stabilized smaller voltage or a larger current may be enabled because of lower temperature dependence by resistors.

Figure 2:
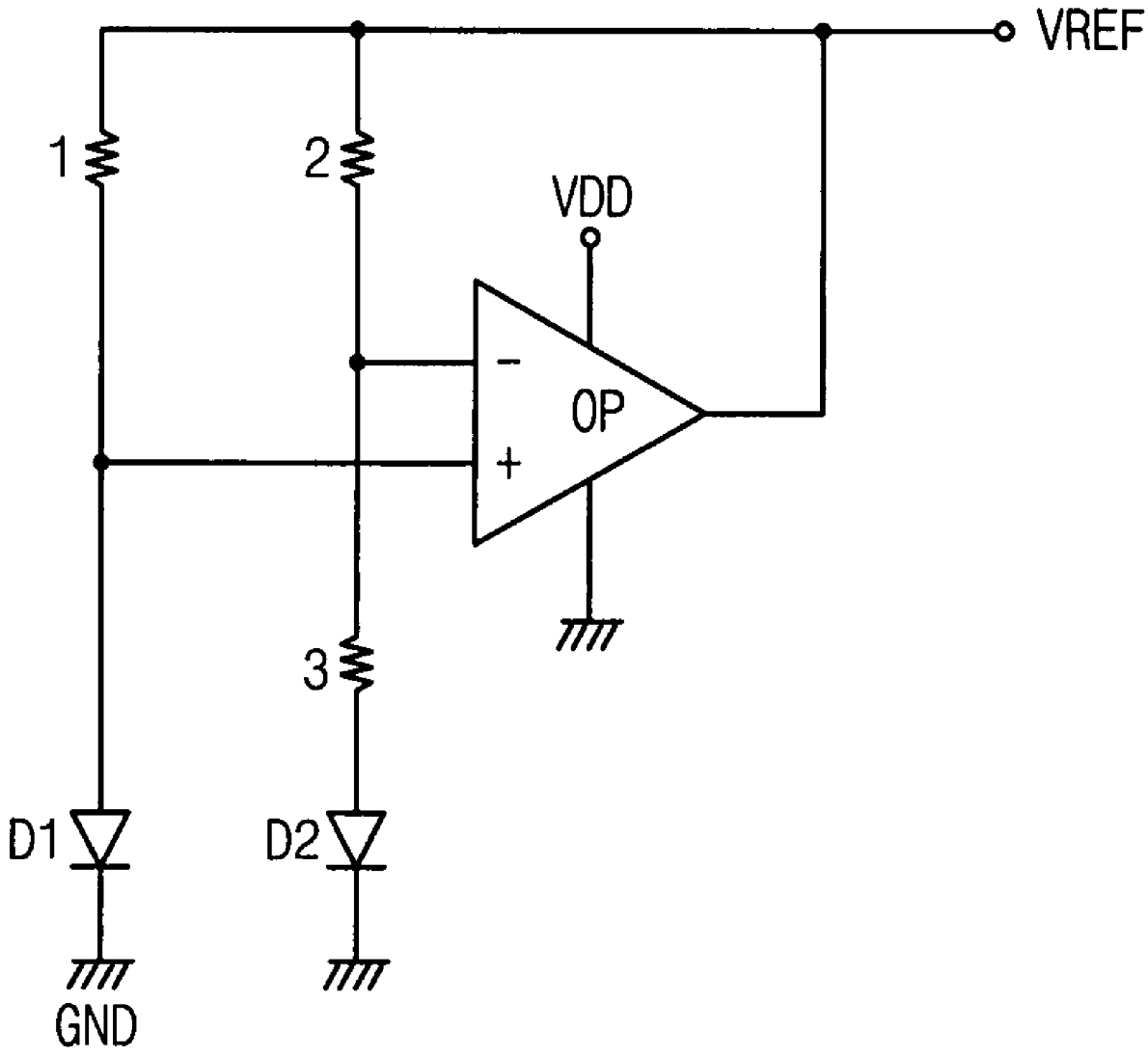
FIG. 2 is an example circuit diagram of a gap reference circuit according to an example embodiment.

FIG. 2 is an example circuit diagram of a band gap reference circuit according to an example embodiment. A band gap reference circuit may be configured to provide the reference potential VREF to the voltage generation circuit 100. A resistor 1 may be connected between an output node and a non-inverted input node (+) of an operational amplifier OP, and/or a resistor 2 may be connected between the output node and an inverted input node (−) of the operational amplifier OP. A diode D1 may be connected between the non-inverted input node (+) of the operational amplifier OP and the ground. A resistor 3 and a diode D2 may be connected in series between the inverted input node (−) of the operational amplifier OP and the ground. If sizes of the diodes D1 and D2 and the resistors R1~R3 are optimized, the bandgap reference circuit may be able to output a constant voltage level of about 1.25V even in a condition of temperature variation.

Figure 3:
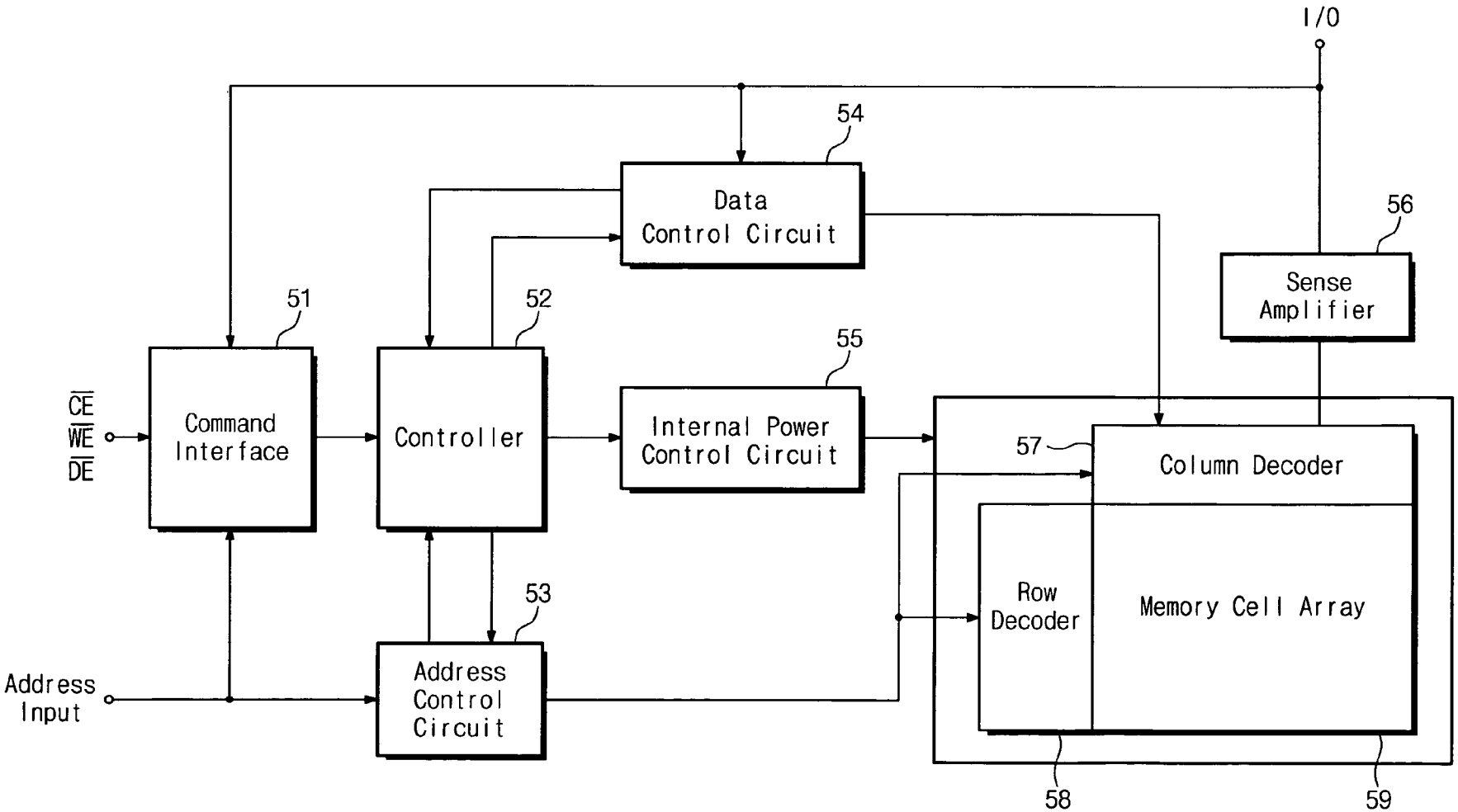
FIG. 3 is an example block diagram of a NOR-type flash memory device according to an example embodiment.
Figure 4:
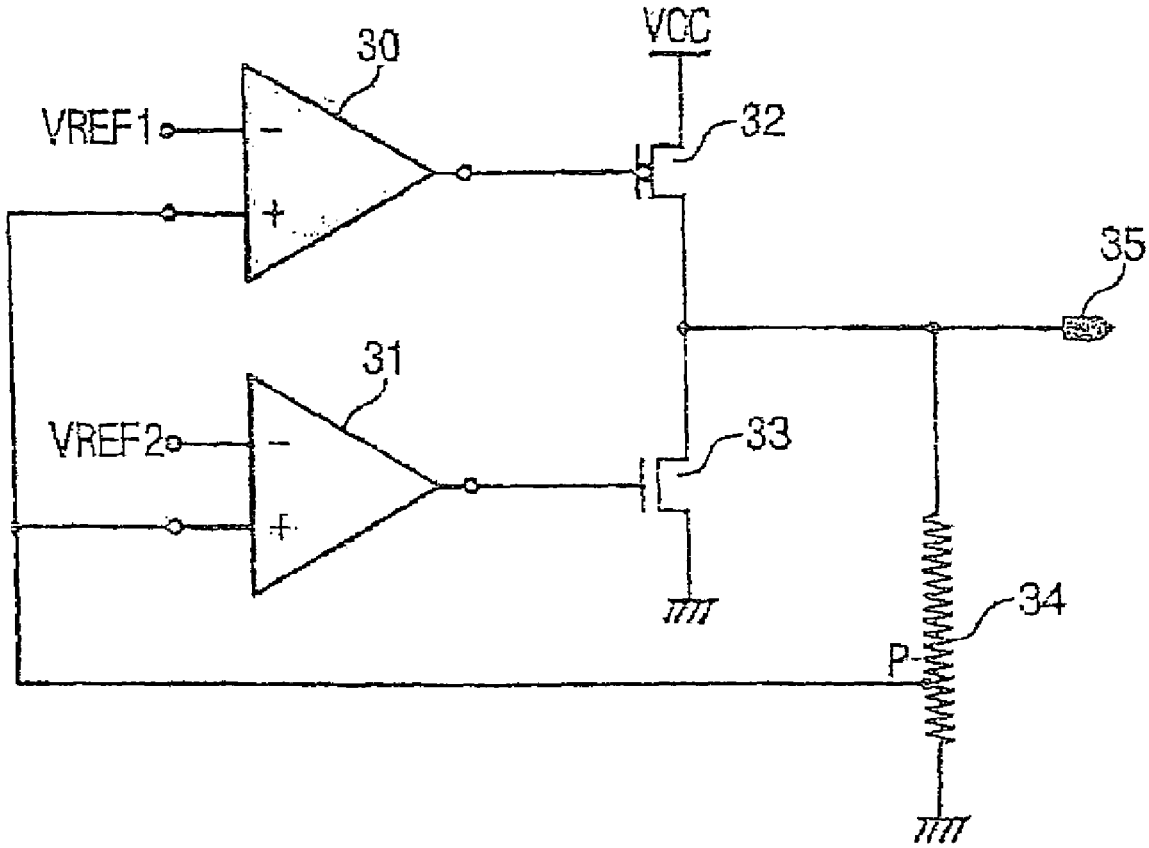
Fig. 4 CONVENTIONAL ART
FIG. 4 is an example circuit diagram of a conventional static-voltage generation circuit.

FIG. 3 is an example block diagram of a NOR-type flash memory device according to an example embodiment. Referring to FIG. 3, a controller 52 may operate to control processes of writing, reading, and/or erasing data in compliance with commands decoded through a command interface 51. The controller 52 may interface with a data control circuit 54 and/or an address control circuit 53. Writing or erasing of data in the NOR-type flash memory device may be carried out using a boosted voltage which is higher than a power source voltage. For example, an internal power control circuit 55 may be embedded in the NOR-type flash memory device. The internal power control circuit 55 may be controlled by the controller 52. An output of the internal power control circuit 55 may be supplied to a row or column line by way of a row decoder 58 or a column decoder 57.

A memory cell array 59 may include a plurality of memory cells of floating-gate field effect transistors (FETs) that are coupled to the row and column lines. The memory cells may be arranged in a matrix pattern. The row decoder 58 included in the flash memory device may drive control gates of the memory cells. The floating-gate FET may include a source and drain that are formed in a P-type well settled within an N-type well of a semiconductor substrate, a floating gate formed over the substrate through an insulation film between the source and drain, and/or a control gate formed over the floating gate through an intergate insulation film.

For example, a procedure of erasing the flash memory may include biasing gates with a negative voltage, e.g., about −9V. Sources and drains may be conditioned in open states and/or a substrate may be biased with a static voltage, e.g., about 5~9V. Under the aforementioned bias conditions, electrons accumulated in a floating gate may be discharged into the substrate and thereby the memory cells may be erased.

For example, because discharging directions of electrons from the floating gate are irregular, threshold voltages of memory cells may be partially set to be lower than a desired, or alternatively, a permissible range of distribution. If there are memory cells having lower threshold voltages in the memory cell array, there may be a current flowing through a column line in a deselected state for which a row line voltage is 0V. Accordingly, it may be impossible to read information from a selected memory cell with the sense amplifier 56.

In determining if threshold voltages of the memory cells of the memory cell array 59 are conditioned lower than a desired, or alternatively, a permissible range of distribution, all row lines of the memory cells are deselected. The sense amplifier 56 may check a status of threshold voltages of the memory cell array by using an assistant power source of about 0.2-0.3V of the row decoder 58 as a potential of deselected row lines. For example, the internal power control circuit 55 may include the voltage generation circuit of example embodiments, and the voltage control circuit may provide a smaller voltage as the power source for a potential of deselected row lines so that the sense amplifier 56 may check a status of threshold voltages of the memory cell array.

Therefore, by providing the internal power control circuit 55 with the voltage generation circuit according to example embodiments and/or operating the internal power control circuit 55 with the controller 52, the NOR-type flash memory device may be able to check a status of threshold voltages of the memory cell array 59 during the erasing operation.

Figure 5:
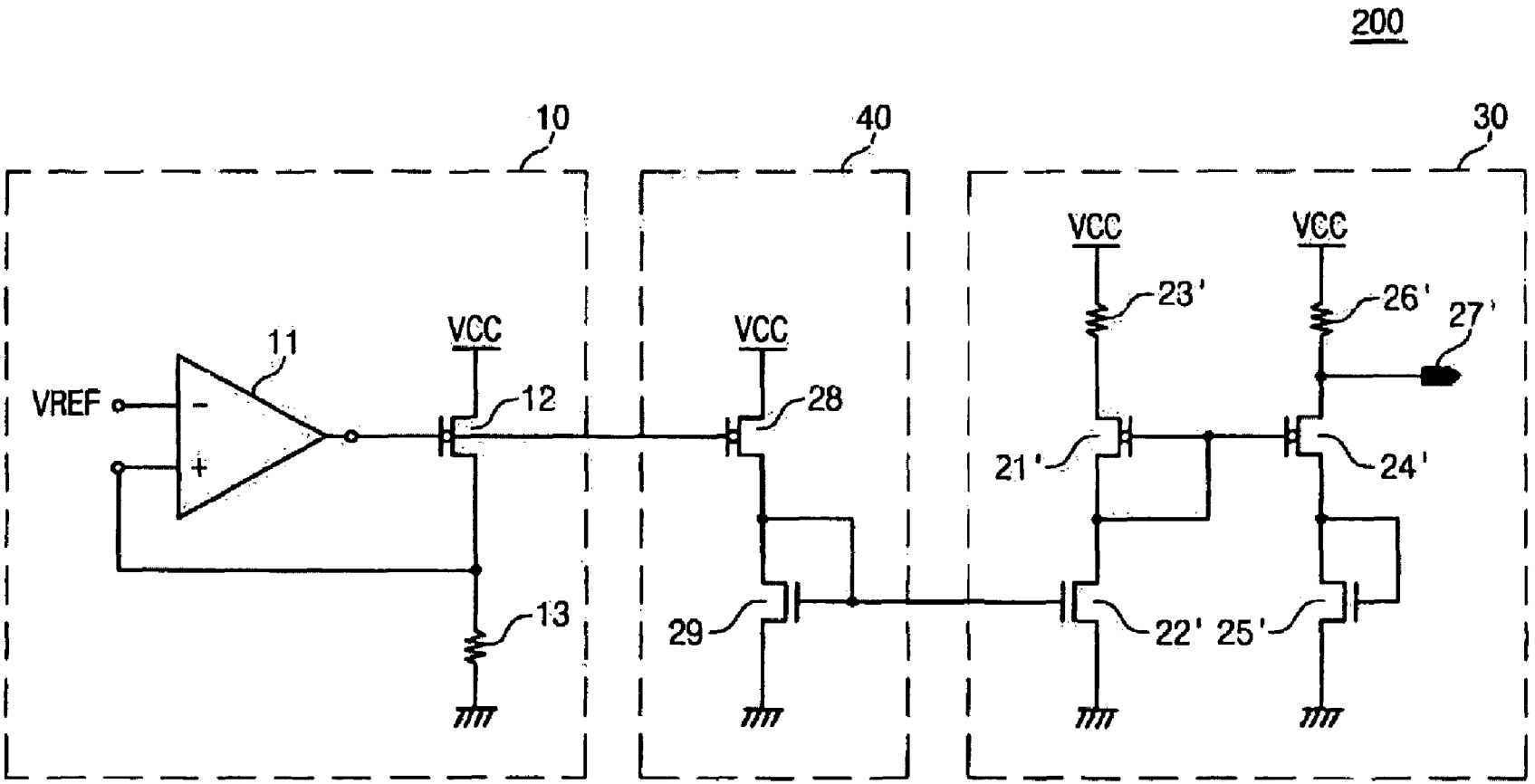
FIG. 5 is an example circuit diagram illustrating a voltage generation circuit according to another example embodiment.

FIG. 5 is a circuit diagram illustrating a voltage generation circuit according to another example embodiment. Referring to FIG. 5, the voltage generation circuit 200 may include a static current circuit 10, a level shifter 40, and/or a current mirror 30. The static current circuit 10 may be the same as the static current circuit 10 of the voltage generation circuit 100 shown in FIG. 1.

The level shifter 40 may include a fourth PMOS transistor 28 and/or a third NMOS transistor 29. A source of the fourth PMOS transistor 28 may be connected to the power source voltage VCC, and/or a gate of the fourth PMOS transistor 28 may be coupled to the gate of the first PMOS transistor 12. A drain and gate of the third NMOS transistor 29 may be commonly connected to a drain of the fourth NMOS transistor 28 and/or a source of the third NMOS transistor 29 may be grounded.

The current mirror 30 may include a first NMOS transistor 22' having a source connected to the ground and/or a gate coupled to a gate of the third NMOS transistor 29, a second PMOS transistor 21' having a drain and gate commonly connected to a drain of the first NMOS transistor 22', a second resistor 23' connected between a source of the second PMOS transistor 21' and the power source voltage VCC, a second NMOS transistor 25' having a source connected to the ground and/or a drain and gate coupled to each other, a third PMOS transistor 24' having a drain connected to a drain of the second NMOS transistor 25' and/or a gate coupled to the gate of the second PMOS transistor 21', a third resistor 26' connected between a source of the third PMOS transistor 24' and the power source voltage VCC, and/or an output terminal 27' connected to the source of the third PMOS transistor 24'.

Referring to FIG. 5, the static current circuit 10, similar to the static current circuit 10 of the voltage generation circuit 100 shown in FIG. 1, may operate to maintain a desired, or alternatively, a predetermined current I1'. A gate voltage Vgp1 of the first PMOS transistor 12 may be applied to the gate of the fourth PMOS transistor 28. The first and fourth PMOS transistors 12 and 28 may have the same gate width to length (W/L) ratio and/or the third NMOS transistor 29 may have a gate width to length (W/L) ratio to make the current I1', so that the gate voltage Vgp1 may be converted into a gate voltage Vgp3 to drive the third NMOS transistor 29.

The gate voltage Vgp3 may be applied to the gate of the first NMOS transistor 22'. The first NMOS transistor 22' may have the same gate width to length ratio (W/L) as the third NMOS transistor 29. Accordingly, a current I2' flowing through the first NMOS transistor 22' may be the same as the current I1'. Gate width to length (W/L) ratios of the third PMOS transistor 24' and the second NMOS transistor 25' may be a number n times the gate width to length ratios (W/L) of the second PMOS transistor 21' and the first NMOS transistor 22'. Accordingly, the current mirror 30 may operate to induce a current I3' (=n*I2') through the third resistor 26'.

The resistance R3' of the third resistor 26' may be 1/n of the resistance R2' of the second resistor 23' and/or a terminal voltage to the power source voltage VCC of the second resistor 23' is referred to as V2'. Accordingly, a terminal voltage V3' to the power source voltage VCC across the third resistor 26' is V3'=I3'*R3'=n*I2'*R2'/n=I2'*R2'=V2'.

In a case of requiring a smaller voltage lower than 1.0V, by generating the reference voltage VREF with the band gap reference circuit, a voltage generation circuit 100 may be able to receive a substantially constant voltage of about 1.25V regardless of variation of power source voltage or temperature. Accordingly, by optimizing the resistance R2' of the second resistor 23', a smaller static voltage less than 1.0V, for example a smaller static voltage infinitesimally smaller than the power source voltage VCC, may be obtained.

In transitioning a load into the smaller voltage from the power source voltage VCC, the voltage generation circuit 100 may be able to charge the load at a higher frequency because the third PMOS transistor 24' driving the load is a source follower. In order to set larger drivability, the current I1' may be maintained by the first PMOS transistor 12, the gate width to length (W/L) ratios of the third PMOS transistor 24' and the second NMOS transistor 25' may be a number n times the gate width to length (W/L) ratios the second PMOS transistor 21' and the first NMOS transistor 22', respectively, and/or the resistance R3' of the third resistor 26' may be designed to be 1/n the resistance R2' of the second resistor 23'. Accordingly, it may be possible to set n times drivability to a larger-capacity load.

The first resistor 13, the second resistor 23', and the third resistor 26' may include a polysilicon layer, a diffusion layer, or a composite of a polysilicon layer and a diffusion layer. Accordingly, a process imbalance may be lightened, for example, as compared to a transistor-type device, and/or a stabilized smaller voltage or a larger current may be enabled because of lower temperature dependence by resistors.

The voltage generation circuit according to example embodiments may be able to set a supply current using a smaller voltage. Accordingly, a faster voltage transition of a load may be conducted. The resistors of the static current circuit setting a static current may be formed to generate a stabilized smaller voltage or a larger current because of their lower temperature dependence and/or smaller process imbalance, for example, as compared to a transistor-type device. Moreover, by applying the voltage generation circuit 100 of example embodiments, threshold voltage conditions of a memory cell array may be checked during an erasing operation.

The voltage generation circuit according to example embodiments may be able to set a supply current at a desired, or alternatively, a predetermined rate, to conduct a faster voltage transition. The resistors of the static current circuit setting a static current may be formed to generate a stabilized smaller voltage or a larger current because of their lower temperature dependence and/or smaller process imbalance, for example, as compared to a transistor-type device.

Although example embodiments have been shown and described in this specification and figures, it would be appreciated by those skilled in the art that changes may be made to the illustrated and/or described example embodiments without departing from their principles and spirit.

What is claimed is:

1. A voltage generation circuit, comprising:

a static current circuit, the static current circuit including, an operational amplifier including an inverted input terminal configured to receive a reference potential, a first PMOS transistor including a drain and gate connected to an non-inverted input terminal and an output node of the operational amplifier, respectively, and a source connected to a power source voltage, and a first resistor connected between the drain of the first PMOS transistor and a ground; and a current mirror, the current mirror including, a second PMOS transistor including a source connected to the power source voltage and a gate connected to the gate of the first PMOS transistor, a first NMOS transistor including a drain and gate commonly connected to a drain of the second PMOS transistor, a second resistor connected between a source of the first NMOS transistor and the ground, a third PMOS transistor including a source connected to the power source voltage and a gate and drain connected to each other, a second NMOS transistor including a drain connected to the drain of the third PMOS transistor and a gate connected to the gate of the first NMOS transistor, a third resistor connected between a source of the second NMOS transistor and the ground, and an output terminal connected to the source of the second NMOS transistor.

2. The circuit of claim 1, wherein the first through third resistors include at least one of a polysilicon layer, a diffusion layer, and a composite of a polysilicon layer and a diffusion layer.

3. The circuit of claim 1, wherein the reference potential is generated by a band gap reference circuit.

4. The circuit of claim 1, wherein an output of the current mirror is provided to a row decoder of a semiconductor memory device.

5. A voltage generation circuit, comprising:

a static current circuit, the static current circuit including, an operational amplifier including an inverted input terminal configured to receive a reference potential, a first PMOS transistor including a drain and gate connected to an non-inverted input terminal and an output node of the operational amplifier, respectively, and a source connected to a power source voltage, and a first resistor connected between the drain of the first PMOS transistor and a ground;

a level shifter, the level shifter including, a fourth PMOS transistor including a source connected to the power source voltage and a gate connected to the gate of the first PMOS transistor, and a third NMOS transistor including a drain and gate commonly connected to a drain of the fourth PMOS transistor; and a current mirror, the current mirror including, a first NMOS transistor including a source connected to the ground and a gate connected to the gate of the third NMOS transistor, a second PMOS transistor including a drain and gate commonly connected to a drain of the first NMOS transistor, a second resistor connected between a source of the second PMOS transistor and the power source voltage, a second NMOS transistor including a source connected to the ground and a drain and gate connected to each other, a third PMOS transistor including a drain connected to the drain of the second NMOS transistor and a gate connected to the gate of the second PMOS transistor, a third resistor connected between a source of the third PMOS transistor and the power source voltage, an output terminal connected to the source of the third PMOS transistor.

6. The circuit of claim 5, wherein the first through third resistors include at least one of a polysilicon layer, a diffusion layer, and a composite of a polysilicon layer and a diffusion layer.

7. The circuit of claim 5, wherein the reference potential is generated by a band gap reference circuit.

8. A voltage generation circuit, comprising:

a static current circuit configured to receive a reference potential, maintain a first current flowing through a first resistor, and output a first voltage; and a current mirror configured to receive the first voltage, maintain a second current flowing through a second resistor in response to the first voltage, the second current being equal to the first current, maintain a third current flowing through a third resistor in response to the first voltage, the third current being equal to a number n times the second current, n being larger than 1 , and output an output voltage equal to a voltage level of the voltage across terminals of the third resistor, wherein the static current circuit includes, an operational amplifier including an inverted input terminal configured to receive the reference potential, a first PMOS transistor including a drain and gate connected to an non-inverted input terminal and an output node of the operational amplifier, respectively, and a source connected to a power source voltage, wherein the first resistor is connected between the drain of the first PMOS transistor and a ground; and the current mirror includes, a second PMOS transistor including a source connected to the power source voltage and a gate connected to the gate of the first PMOS transistor, a first NMOS transistor including a drain and gate commonly connected to a drain of the second PMOS transistor, wherein the second resistor is connected between a source of the first NMOS transistor and the ground, and a third PMOS transistor including a source connected to the power source voltage and a gate and drain connected to each other, a second NMOS transistor including a drain connected to the drain of the third PMOS transistor and a gate connected to the gate of the first NMOS transistor, wherein the third resistor is connected between a source of the second NMOS transistor and the ground, and an output terminal connected to the source of the second NMOS transistor.

9. The circuit of claim 8, wherein a resistance of the third resistor is 1/n the resistance of the second resistor.

10. The circuit of claim 8, wherein the first through third resistors include at least one of a polysilicon layer, a diffusion layer, and a composite of a polysilicon layer and a diffusion layer.

11. The circuit of claim 8, wherein the first and second PMOS transistors have the same gate width to length (W/L) ratio, and the gate width to length (W/L) ratios of the third PMOS transistor and the second NMOS transistor are n times the gate width to length (W/L) ratio of the second PMOS transistor.

12. A voltage generation circuit, comprising:

a static current circuit configured to receive a reference potential, maintain a first current flowing through a first resistor, and output a first voltage;

a current mirror configured to receive the first voltage, maintain a second current flowing through a second resistor in response to the first voltage, the second current being equal to the first current, maintain a third current flowing through a third resistor in response to the first voltage, the third current being equal to a number n times the second current, n being lager than 1, and output an output voltage equal to a voltage level of the voltage across terminals of the third resistor;

a level shifter, wherein the static current circuit includes, an operational amplifier including an inverted input terminal configured to receive the reference potential, a first PMOS transistor including a drain and gate connected to an non-inverted input terminal and an output node of the operational amplifier, respectively, and a source connected to a power source voltage, wherein the first resistor is connected between the drain of the first PMOS transistor and a ground;

the level shifter includes, a fourth PMOS transistor including a source connected to the power source voltage and a gate connected to the gate of the first PMOS transistor, and a third NMOS transistor including a drain and gate commonly connected to a drain of the fourth PMOS transistor; and the current mirror includes, a first NMOS transistor including a source connected to the ground and a gate connected to the gate of the third NMOS transistor, a second PMOS transistor including a drain and gate commonly connected to a drain of the first NMOS transistor, wherein the second resistor is connected between a source of the second PMOS transistor and the power source voltage, a second NMOS transistor including a source connected to the ground and a drain and gate connected to each other, a third PMOS transistor including a drain connected to the drain of the second NMOS transistor and a gate connected to the gate of the second PMOS transistor, wherein the third resistor is connected between a source of the third PMOS transistor and the power source voltage, and an output terminal connected to the source of the third PMOS transistor.

13. The circuit of claim 12, wherein the first and fourth PMOS transistors have the same gate width to length (W/L) ratio, the first NMOS transistor and the third NMOS transistor have the same gate width to length (W/L) ratio, and the gate width to length (W/L) ratios of the third PMOS transistor and the second NMOS transistor are n times the gate width to length (W/L) ratios of the second PMOS transistor and the first NMOS transistor.

* * * * *